US005375672A

United States Patent [19]

Peay et al.

[11] Patent Number: 5,375,672

[45] Date of Patent: Dec. 27, 1994

[54] MINE ROOF DRILL BIT AND CUTTING INSERT THEREFOR

[75] Inventors: Kent Peay, Bristol, Tenn.; Jan Akerman, Stockholm, Sweden

[73] Assignee: Sandvik Rock Tools, Inc., Bristol, Va.

[21] Appl. No.: 964,838

[22] Filed: Oct. 22, 1992

[51] Int. Cl.[5] ..... E21B 10/46

[52] U.S. Cl. ..... 175/420.1; 175/426

[58] Field of Search ..... 175/420.1, 426, 414, 175/415, 417, 418; 408/223, 227

[56] References Cited

U.S. PATENT DOCUMENTS

| | | | |
|---|---|---|---|
| 2,902,260 | 9/1959 | Tilden | 175/420.1 X |
| 3,049,033 | 8/1962 | Benjamin et al. | 175/420.1 X |
| 4,120,601 | 10/1978 | Benjamin | 408/223 X |
| 4,313,506 | 2/1982 | O'Connell . | |
| 4,381,162 | 4/1983 | Hosoi . | |
| 4,492,278 | 1/1985 | Leighton . | |
| 4,984,944 | 1/1991 | Pennington, Jr. et al. | 175/420.1 X |
| 5,172,775 | 12/1992 | Sheirer et al. | 175/420.1 X |
| 5,184,689 | 2/1993 | Sheirer et al. | 175/420.1 |
| 5,220,967 | 6/1993 | Monyak | 175/420.1 |

*Primary Examiner*—Hoang C. Dang

*Attorney, Agent, or Firm*—Burns, Doane, Swecker & Mathis

[57] ABSTRACT

An insert for use in a roof bit for drilling bolt holes in a mine roof includes a pair of cutting edges interconnected by a chisel edge. Each cutting edge is formed by an intersection of front and side faces of the insert. Each side face further includes at least one chamfer intersecting the respective cutting edge and the chisel edge to divide that cutting edge into inner and outer sections, each of which being sharper than the chisel edge.

12 Claims, 2 Drawing Sheets

FIG. 1
(PRIOR ART)
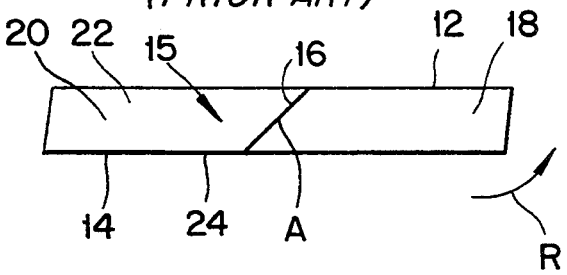
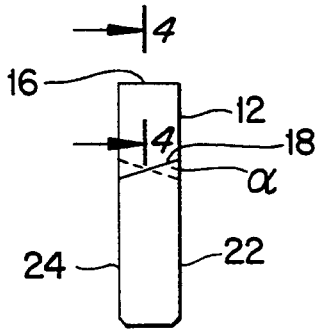
FIG. 3
(PRIOR ART)
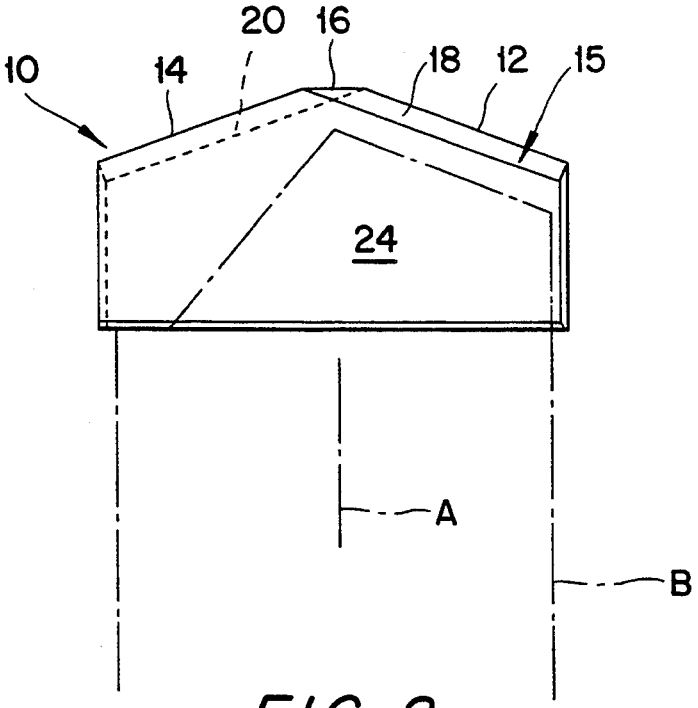
FIG. 2
(PRIOR ART)
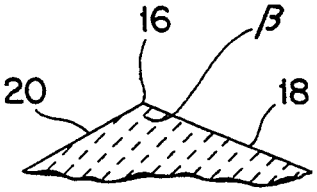
FIG. 4
(PRIOR ART)

FIG. 5
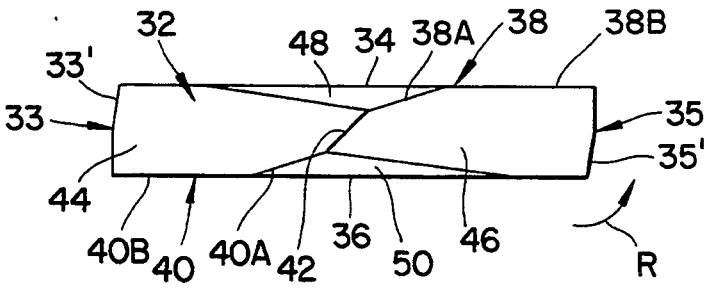
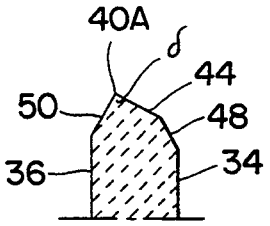
FIG. 8
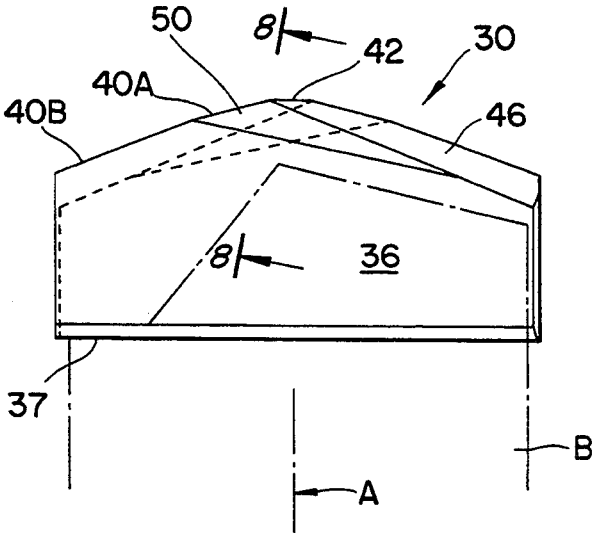
FIG. 6
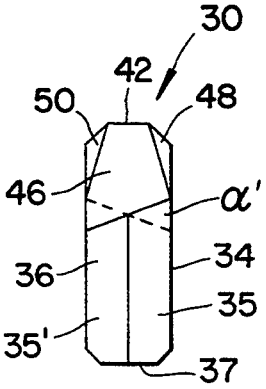
FIG. 7
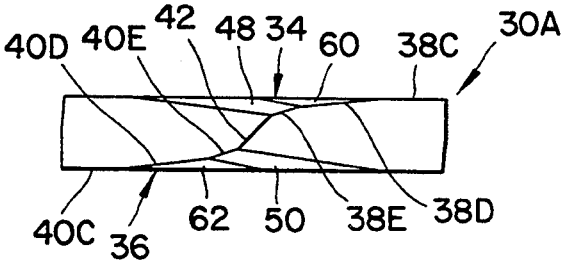
FIG. 9
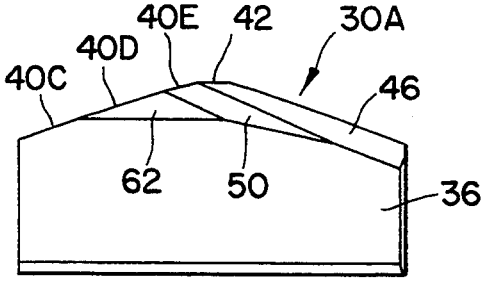
FIG. 10

MINE ROOF DRILL BIT AND CUTTING INSERT THEREFOR

BACKGROUND OF THE INVENTION

The present invention relates to the supporting of mine roofs and, in particular, to a cutting insert for use in a drill bit for cutting holes in a mine roof.

During mining operations, the roof of the mine must be supported. This has traditionally been accomplished by bolting support plates to the roof, the bolts being installed in pre-drilled holes in the mine roof.

It has been conventional to drill the bolt-receiving holes by means of a drill bit on which is mounted a cutting insert. The cutting insert, formed of a hard material such as cemented carbide for example, is mounted, e.g., by brazing, in a slot formed in a bit body, as depicted for example in U.S. Pat. No. 4,492,278. A conventional insert 10, depicted herein in FIGS. 1–4, includes a pair of linear cutting edges 12, 14 situated on opposite sides of a front face 15 of the insert. Those cutting edges are joined at the center of the insert by a linear central portion or chisel edge 16 which divides the front face into first and second sections 18, 20. Each section of the front face, and thus each of the cutting edges 12, 14, extends laterally outwardly and longitudinally rearwardly with reference to the axis of rotation A of the bit body B.

When the bit body B is rotated, the cutting edges 12, 14 and the chisel edge 16 perform a cutting action. The side faces 22, 24 of the insert serve as chip faces for the cutting edges 12, 14, respectively, and the front face sections 18, 20 serve as chip faces for the chisel edge 16. The angle $\alpha$ (see FIG. 3) included between the faces 18 and 22 (and thus between faces 20 and 24) is about 70 degrees, whereas the angle $\beta$ (FIG. 4) included between the faces 18 and 20 at the chisel 16 is about 140 degrees. Due to the relatively large angle $\beta$, the chisel edge 16 is relatively blunt and unable to perform a significant cutting action; rather, it performs a crushing action on the material forming the mine roof as the insert is longitudinally advanced.

Since it is necessary to drill many holes in the roof of a mine in order that sufficient support can be established, it is desirable that the bit be able to drill each hole as rapidly as possible. Also, it is desirable to maximize the toughness of the insert so that the insert lasts longer and thereby reduces the drilling costs.

SUMMARY OF THE INVENTION

The present invention relates to a mine roof cutting insert, and to a mine roof drill bit containing that insert. The insert comprises a body having a front face and two opposing side faces intersecting the front face to form therewith two cutting edges disposed on respective sides of the insert. The front face includes angularly related sections extending rearwardly and laterally outwardly. The sections of the front face intersect at the center of the front face to form a chisel edge. The chisel edge interconnects inner ends of the cutting edges. Each of the side faces includes a chamfer intersecting a respective cutting edge and the chisel edge, to divide the respective cutting edge into angularly related cutting edge sections, each of which being sharper than the chisel edge.

BRIEF DESCRIPTION OF THE DRAWINGS

The objects and advantages of the invention will become apparent from the following detailed description of a preferred embodiment thereof in connection with the accompanying drawings in which like numerals designate like elements, and in which:

FIG. 1 is a front end view of a prior art insert for use in a mine roof bit;

FIG. 2 is a side elevational view of the prior art insert depicted in FIG. 1, mounted to a bit body shown in phantom lines;

FIG. 3 is a view of the prior art insert taken in a direction offset by 90° from the position shown in FIG. 2;

FIG. 4 is a fragmentary sectional view taken along the line 4—4 in FIG. 3;

FIG. 5 is a front end view of a cutting insert according to the present invention;

FIG. 6 is a side elevational view of the insert depicted in FIG. 5 mounted in a bit body shown in phantom lines;

FIG. 7 is an elevational view of the insert depicted in FIG. 6 taken in a direction offset by 90° from the position shown in FIG. 6;

FIG. 8 is a fragmentary sectional view taken along line 8—8 in FIG. 6;

FIG. 9 is a front end view of a second preferred embodiment of the insert according to the present invention; and FIG. 10 is a side elevational view of the insert depicted in FIG. 9.

DETAILED DESCRIPTION OF A PREFERRED EMBODIMENT OF THE INVENTION

A cutting insert 30 for use in a mine roof drill bit is depicted in FIGS. 5–8. The insert 30, which is mounted in a conventionally configured cylindrical bit body (e.g., by brazing), comprises a body formed of a hard substance such as cemented carbide having a front face 32, a pair of end faces 33, 35, a pair of side faces 34, 36, and a flat bottom 37. Each end face includes a trailing portion 33', 35' which is inclined with respect to its associated leading portion to define a relief.

The side faces 34, 36 intersect the front face 32 to form a pair of cutting edges 38, 40, respectively, which are oriented symmetrically wit respect to an axis of rotation A of the bit. The cutting edges are joined by a central chisel edge 42 which extends perpendicular to the axis of rotation A. The chisel edge 42 divides the front face into two surface sections 44, 46 which extend laterally outwardly and longitudinally rearwardly from the chisel edge 42.

As thus-far described, the insert 30 is identical to the earlier described prior art insert 10. However, in accordance with the present invention, formed in each side face 34, 36 is a chamfer surface or flat 48, 50 which intersects a respective cutting edge 38, 40 and the chisel edge 42. Each chamfer divides its respective cutting edge 38, 40 into inner and outer cutting edge sections 38A, 38B and 40A, 40B. The chisel edge interconnects the inner cutting edge sections 38A, 40A, and is thus of shorter length than the prior art chisel edge 16 of FIGS. 1–4. The side surfaces 34, 36 serve as chip faces for the edge outer sections 38B, 40B, respectively; the chamfers 48, 50 serve as chip faces for the edge inner sections 38A, 40A, respectively. The sections 44 and 46 of the front face serve as chip faces for respective halves of the chisel edge 46. That is, the face section 44 serves as a chip face for the half of the chisel edge 42 extending from axis A to the chamfer 48, whereas the face section 46 serves as a chip face for the other half of the chisel edge 42.

The angle included between the face section 44 and the side face 36 (and thus also between the face section 46 and the side face 34) is 70 degrees (similar to the earlier mentioned angle $\alpha$ of the prior art). The angle included between the sections 44 and 46 at the chisel is about 140 degrees (similar to the earlier mentioned angle $\beta$ of the prior art). The angle $\delta$ (FIG. 8) included between the chamfer 50 and the face section 44 (and thus also between the chamfer 48 and the face section 46) is in the range of 92 to 112 degrees, and preferably is about (102) degrees.

Therefore, it will be appreciated that the inner and outer sections 38A, 38B and 40A, 40B of the cutting edges 40, 38 are sharper than the chisel edge 42 (i.e., an included angle of 102 degrees for the inner edge sections 40A, 38A versus an included angle of 140 degrees for the chisel edge), and are thus able to perform a more effective cutting action. In other words, a portion of the relatively blunt chisel edge 42 has been replaced by a sharper edge 38A, 40A to enable the drilling rate to be increased.

It will be appreciated that each side 34, 36 of the insert could be provided with more than one chamfer or flat as shown, for example, in the insert 30A depicted in FIGS. 9 and 10 wherein the side wall 34 is provided with a second chamfer surface or flat 60, and the side wall 36 is provided with a second chamfer surface or flat 62. Thus, each cutting edge comprises three sections 38C, 38D, 38E and 40C, 40D, 40E, each of which being sharper than the chisel edge 42.

Although the present invention has been described in connection with a preferred embodiment thereof, it will be appreciated by those skilled in the art that additions, modifications, substitutions, and deletions not specifically described may be made without departing from the spirit and scope of the invention as defined in the appended claims.

What is claimed is:

1. A mine roof cutting insert for use in a mine roof drill bit to cut a hole in a mine roof, the mine roof cutting insert comprises:

a body having a front face, a bottom face disposed opposite the front face, two end faces each interconnecting the front and bottom faces, and two substantially planar, opposing first and second side faces each interconnecting said two end faces, said first and second side faces intersecting said front face to form therewith first and second cutting edges, respectively;

said front face including angularly related first and second surface sections each extending rearwardly and laterally outwardly, said first and second surface sections intersecting one another at a center of said front face to form a chisel edge, first and second ends of said chisel edge interconnecting inner ends of said first and second cutting edges, respectively;

a substantially planar first chamfer surface intersecting: said first side surface, both of said first and second surface sections, and said first end of said chisel edge, to divide said first cutting edge into a first pair of angularly related cutting edge sections, each of which being sharper than said cutting edge, and one of which extending from said first end of said chisel edge;

a substantially planar second chamfer surface intersecting: said second side surface, both of said first and second surface sections, and said second end of said chisel edge, to divide said second cutting edge into a second pair of angularly related cutting edge sections, each of which being sharper than said chisel edge, and one of which extending from said second end of said chisel edge.

2. A mine roof cutting insert according to claim 1, wherein said first surface section forms a first angle of from 92 to 112 degrees with said first chamfer surface, and said second surface section forming a second angle of from 92 to 112 degrees with said second chamfer surface, each of said first and second angles being smaller than a third angle formed by the intersection of said first and second surface sections at said chisel edge.

3. A mine roof cutting insert according to claim 2, wherein each of said first and second angles is about 102 degrees.

4. A mine roof cutting insert according to claim 3, wherein said third angle is about 140 degrees.

5. A mine roof cutting insert according to claim 1, wherein each of said first and second chamfer surfaces is of triangular shape.

6. A mine roof cutting insert according to claim 1 including a first additional chamfer surface intersecting: said first chamfer surface, said first pair of cutting edge sections, said first surface section, and said first side surface for dividing said first pair of cutting edge sections into three cutting edge sections; and a second additional chamfer surface intersecting said second chamfer surface, said second pair of cutting edge sections, said second surface section, and said second side surface for dividing said second pair of cutting edge sections into three cutting edge sections.

7. A mine roof drill bit for drilling a hole in a mine roof, comprising:

a generally cylindrical bit body having a front end, and a second cutting mounted in said front end, said cutting insert comprising:

a body having a front face, a bottom face disposed opposite the front face, two end faces each interconnecting the front and bottom faces, and two substantially planar, opposing first and second side faces each interconnecting said two end faces, said first and second side faces intersecting said front face to form therewith first and second cutting edges, respectively;

said front face including angularly related first and second surface sections each extending rearwardly and laterally outwardly, said first and second surface sections intersecting one another at a center of said front face to form a chisel edge, first and second ends of said chisel edge interconnecting inner ends of said first and second cutting edges, respectively;

a substantially planar first chamfer surface intersecting: said first side surface, both of said first and second surface sections, and said first end of said chisel edge, to divide said first cutting edge into a first pair of angularly related cutting edge sections, each of which being sharper than said cutting edge, and one of which extending from said first end of said chisel edge;

a substantially planar second chamfer surface intersecting: said second side surface, both of said first and second surface sections, and said second end of said chisel edge, to divide said second cutting edge into a second pair of angularly related cutting edge sections, each of which being sharper than said chisel edge, and one of which extending from said second end of said chisel edge.

8. A mine roof drill bit according to claim 7, wherein said first surface section forms a first angle of from 92 to 112 degrees with said first chamfer surface, and said second surface section forming a second angle of from 92 to 112 degrees with said second chamfer surface, each of said first and second angles being smaller than a third angle formed by the intersection of said first and second surface sections at said chisel edge.

9. A mine roof drill bit according to claim 8, wherein each of said first and second angles is about 102 degrees.

10. A mine roof drill bit according to claim 8, wherein said third angle is about 140 degrees.

11. A mine roof drill bit according to claim 7, wherein each of said first and second chamfer surfaces is of triangular shape.

12. A mine roof drill bit according to claim 7 including a first additional chamfer surface intersecting: said first chamfer surface, said first pair of cutting edge sections, said first surface section, and said first side surface for dividing said first pair of cutting edge sections into three cutting edge sections; and a second additional chamfer surface intersecting: said second chamfer surface, said second pair of cutting edge sections, said second surface section, and said second side surface for dividing said second pair of cutting edge sections into three cutting edge sections.

* * * * *